US007603835B2

(12) United States Patent
Caporale

(10) Patent No.: US 7,603,835 B2
(45) Date of Patent: Oct. 20, 2009

(54) DEVICE FOR FEEDING CARTON BLANKS TO A PACKAGING MACHINE

(75) Inventor: Antonio Caporale, Lazzaro Di Savena (IT)

(73) Assignee: I.M.A. Industria Macchine Automatiche, Ozzano Emilia (Bologne) (IT)

( * ) Notice: Subject to any disclaimer, the term of this patent is extended or adjusted under 35 U.S.C. 154(b) by 251 days.

(21) Appl. No.: 11/817,877

(22) PCT Filed: Mar. 17, 2006

(86) PCT No.: PCT/IB2006/000591

§ 371 (c)(1),
(2), (4) Date: Sep. 6, 2007

(87) PCT Pub. No.: WO2006/097831

PCT Pub. Date: Sep. 21, 2006

(65) Prior Publication Data

US 2008/0159844 A1 Jul. 3, 2008

(30) Foreign Application Priority Data

Mar. 18, 2005 (IT) ..... BO2005A0169

(51) Int. Cl.
*B65B 43/26* (2006.01)
*B65B 43/24* (2006.01)
*B31B 1/80* (2006.01)
*B31B 5/80* (2006.01)

(52) U.S. Cl. ..... 53/564; 53/381.1; 53/389.1; 414/796.4; 414/797.7; 414/797.8; 493/315; 493/318

(58) Field of Classification Search ..... 53/389.1, 53/564, 566, 381.1; 493/315, 318; 271/95; 414/795.4, 796.4, 797.4, 797.7, 797.8, 736; *B65B 43/24, B65B 43/26; B31B 1/80, 5/80*
See application file for complete search history.

(56) References Cited

U.S. PATENT DOCUMENTS 4,194,442 A * 3/1980 Martelli ..... 414/797.7

(Continued)

FOREIGN PATENT DOCUMENTS

DE 19801194 A 7/1999

(Continued)

OTHER PUBLICATIONS

International Search Report for PCT/IB2006/000591.

*Primary Examiner*—Stephen F Gerrity
(74) *Attorney, Agent, or Firm*—William J. Sapone; Coleman Sudol Sapone P.C.

(57) ABSTRACT

A device (100) for feeding blanks (99) to a packaging machine (M), includes at least one rotating group (G) for picking up flat folded carton blanks from the bottom of a stack (94) of blanks (99), in a picking up position (P), by the use of a picking up vacuum device (7) supported by the group (G). Then, the picked up folded blanks are erected into box-like configurations (A) in an erecting position (K). Then, the group (G) feeds the blanks (99) to an inlet station (98) of the machine (M), to place them one by one in the station (98) in a placing position (ID). The group (G) includes one first kinematic series (C1) for determining the movement of the picking up vacuum cups (7) along a closed path (T), extending between the picking up position (P) and the placing position (ID). A second kinematic series (C2) controls and maintains constant the orientation of the picking up vacuum cups (7, V).

10 Claims, 10 Drawing Sheets

U.S. PATENT DOCUMENTS 4,518,301 A * 5/1985 Greenwell ..... 414/797.8
4,871,348 A * 10/1989 Konaka ..... 493/315
5,249,916 A * 10/1993 Portrait et al. ..... 53/567
5,910,078 A 6/1999 Guttinger et al.
6,503,180 B1 * 1/2003 Pluschow et al. ..... 493/315
6,659,928 B2 * 12/2003 Baumeister et al. ..... 493/315
7,040,479 B2 * 5/2006 Fochler et al. ..... 198/409
7,273,343 B2 * 9/2007 Ziegler ..... 414/736
2005/0008470 A1 * 1/2005 Baclija et al. ..... 414/736

FOREIGN PATENT DOCUMENTS

DE 10204932 A 8/2003
JP 11277643 A * 10/1999
WO WO2004074108 A 9/2004
WO WO2005019074 A 3/2005

* cited by examiner

DEVICE FOR FEEDING CARTON BLANKS TO A PACKAGING MACHINE

FIELD OF THE INVENTION

The present invention relates to a device for feeding carton blanks to a packaging machine.

In particular, the proposed invention is advantageously used for picking up flat folded carton blanks from a stack, erecting them, that is making them assume a box- or case-like configuration, and subsequently feeding the box-like erected blanks to a packaging machine, so as to introduce products therein.

BACKGROUND OF THE INVENTION

Generally, the blanks are fed to a packaging machine, e.g. a boxing machine, by picking up devices having a rotating head, and suction means for stripping flat folded blanks from the bottom of a pile, and abutment means for erecting the blanks before their placing in relevant conveyor seats of the packaging machine.

A rotating head device of this type includes substantially mechanisms, e.g. cam and/or epicyclical mechanisms, aimed at operating the above suction picking up means during the head rotation.

Examples of the above devices are described in the U.S. Pat. No. 4,194,442 and in the U.S. Pat. No. 6,503,108.

At present, known picking up devices try to correct the characteristic movement trajectories by applying suitable corrective devices to the moving device, which obviously results in very complicated and considerably bulky mechanisms.

Moreover, the above mentioned devices, described in the cited US patents, pick up the flat surface of the blanks, which are later placed on the conveyors in a conveying station on an opposite flat surface, by turning the blanks by 180 °.

Therefore, it is necessary to perform difficult adjustment operations of the device, when the height or dimension of the used blanks changes.

SUMMARY OF THE INVENTION

The object of the present invention is to avoid the above mentioned disadvantages of the prior art.

The proposed invention is obtained by a device for feeding blanks to a packaging machine, including at least one rotating group for picking up flat folded carton blanks, by picking up means supported by the rotating group, from the bottom of a stack of carton blanks in picking up position, so as to erect them to form a box in a position corresponding to an erected condition, and then feeding them to an inlet station of said machine to place them one by one in the station in a placing position; the device being characterized in that said group includes, integrated with one another, at least one first kinematic series, which determines the movement of said picking up means along a closed path, extending between said picking up position and said placing position; and at least one second kinematic series, which controls and maintains constant the orientation of said picking up means.

BRIEF DESCRIPTION OF THE DRAWINGS

The characteristic features of the invention are clearly understood from the contents of the claims, and the advantages will be better understood from the following detailed description, with reference to the enclosed figures, which show a preferred embodiment as a pure, not limiting example, in which:

PREFERRED MODES OF CARRYING OUT THE INVENTION

Figure 1:
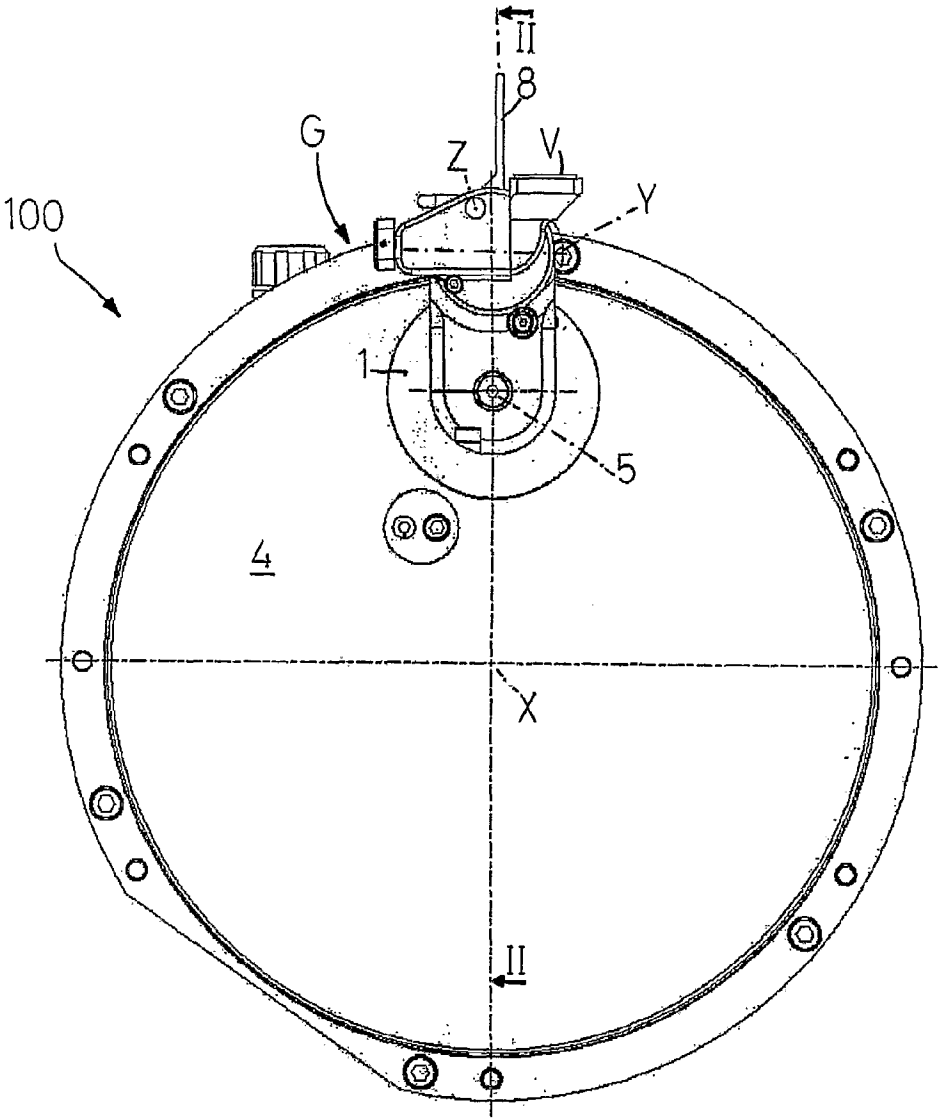
FIG. 1 is a schematic, front view of a preferred embodiment of a device for feeding carton blanks, according to the present invention.
Figure 2:
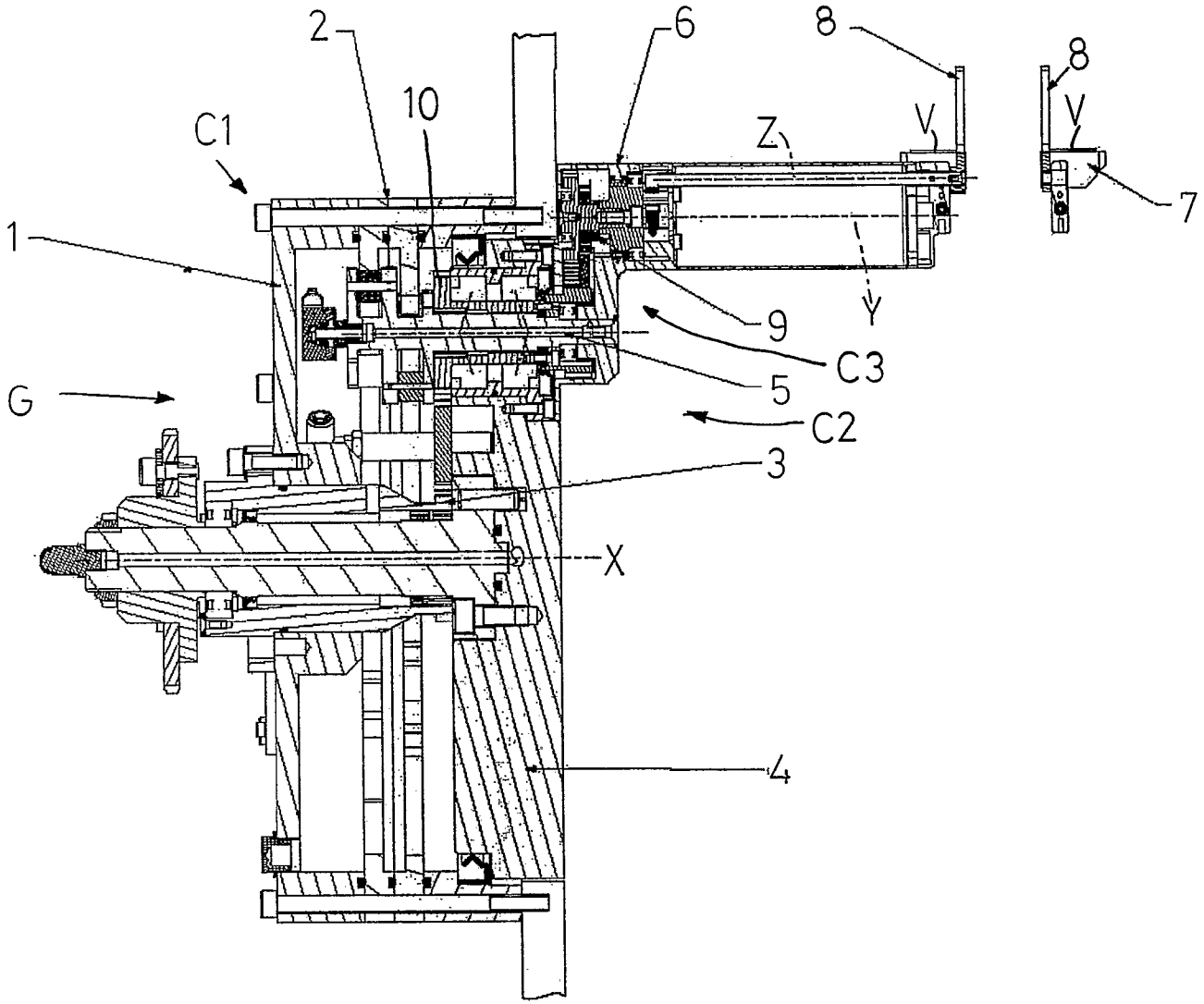
FIG. 2 is a detailed, section view, of a working group of the device of FIG. 1, taken along the II-II and with some parts removed for sake of clarity.
Figure 3A:
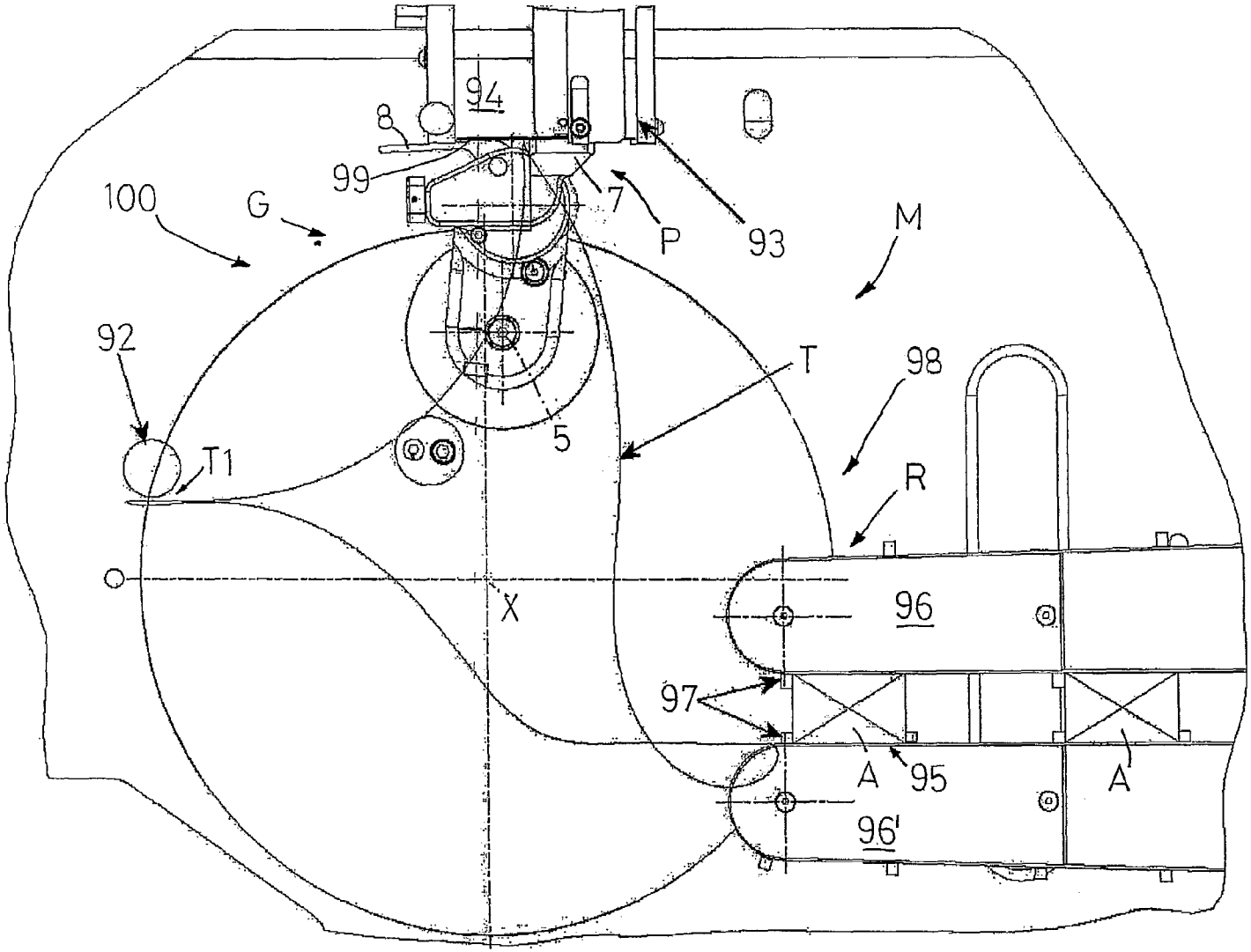
FIGS. 3*a* to 3*h* show corresponding sequences of positions of the operating group shown in FIG. 2.

With reference to FIGS. 1, 2 and 3*a*, the reference numeral 100 indicates a device for feeding carton blanks 99 to an inlet station 98 of a packaging machine M (of which the device 100 is an integral part).

The inlet station 98 includes a pair 97 of conveyors 96, 96' with compartments 95.

The conveyors 96, 96' are arranged above one another and receive and feed the blanks 99, in their open configuration, defining a parallelepiped box or case A, toward subsequent work stations of the machine M (not shown).

Advantageously, the inlet station 98 of the device 100, proposed by the present invention, defines a station R, in which various products are introduced into the cases A, by known introducing means, not shown.

The device 100 includes at least one picking up group G, aimed at stripping flat folded blanks 99, one by one, from the bottom of a stack 94 of blanks 99, situated in a magazine 93, to erect them into a case A, and then to place them, one after another, in the compartments 95 of the pair 97 of conveyors 96, 96' of the station 98.

According to an embodiment, not shown, the device 100 includes preferably at least two picking up groups G, suitably arranged mutually, so as to further increase the picking up speed and rate, while maintaining the stresses on the mechanic parts of the whole device 100 and the picked up blanks 99 unvaried.

As it has been better shown in FIG. 2, the group G includes a rotating head and a framework 1, which carries, fastened thereto, cams 2 and a stationary wheel 3.

A rotor 4, acting as a satellite carrier for a horizontal axis 5, rotates on the framework 1, on a horizontal axis X, parallel to the axis 5, about which a lever 6 rotates.

A suction cup carrier 7 for the suction cups V is situated at the end of the lever 6, to grip the blanks 99 from the bottom of the stack 94, by the vacuum action.

Consequently, the cams 2, the axis 5 and the lever 6 define a first kinematic series C1.

According to FIGS. from 3*a* to 3*h*, the lever 6 moves in a way determined by the combination of the rotation of the rotor 4 on the axis X and by the lever itself rotation on the axis 5, controlled by the cams 2.

The lever 6 movement defines a looped continuous motion path T (FIGS. from 3*a* to 3*h*) for the suction cup carrier 7, which, while running the same path T, moves without rotating, that is it maintains a constant horizontal orientation, due to the correction obtained by the link to the stationary wheel 3, created by a series of gears through a sleeve 10, thus defining a second kinematic series C2.

The group G includes also a pair of rods or extensions 8, cooperating with the suction cup carrier 7 to erect the blanks 99.

Actually, the pair of extensions 8 is aimed at rotating on an axis Z, integral with the suction cup carrier 7.

This movement is obtained by operation of a cam 9, in turn set to rotate on an axis Y of the suction cup carrier 7, by the series of gears, which links it to the motionless wheel 3 via the sleeve 10.

The mechanism formed by cam 9—wheel 3—sleeve 10—extensions 8, defines a third kinematic series C3.

Figure 3B:
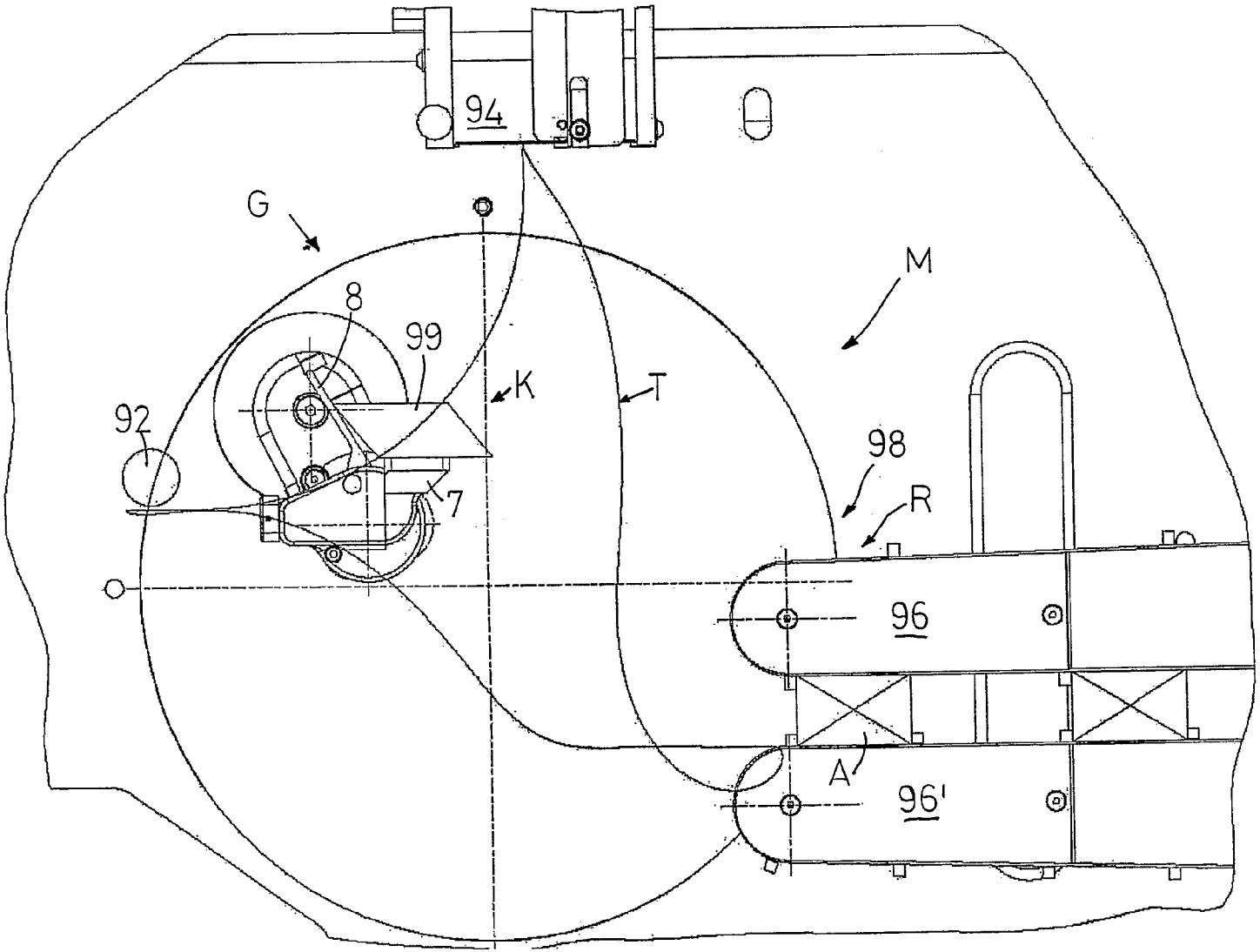
Figure 3C:
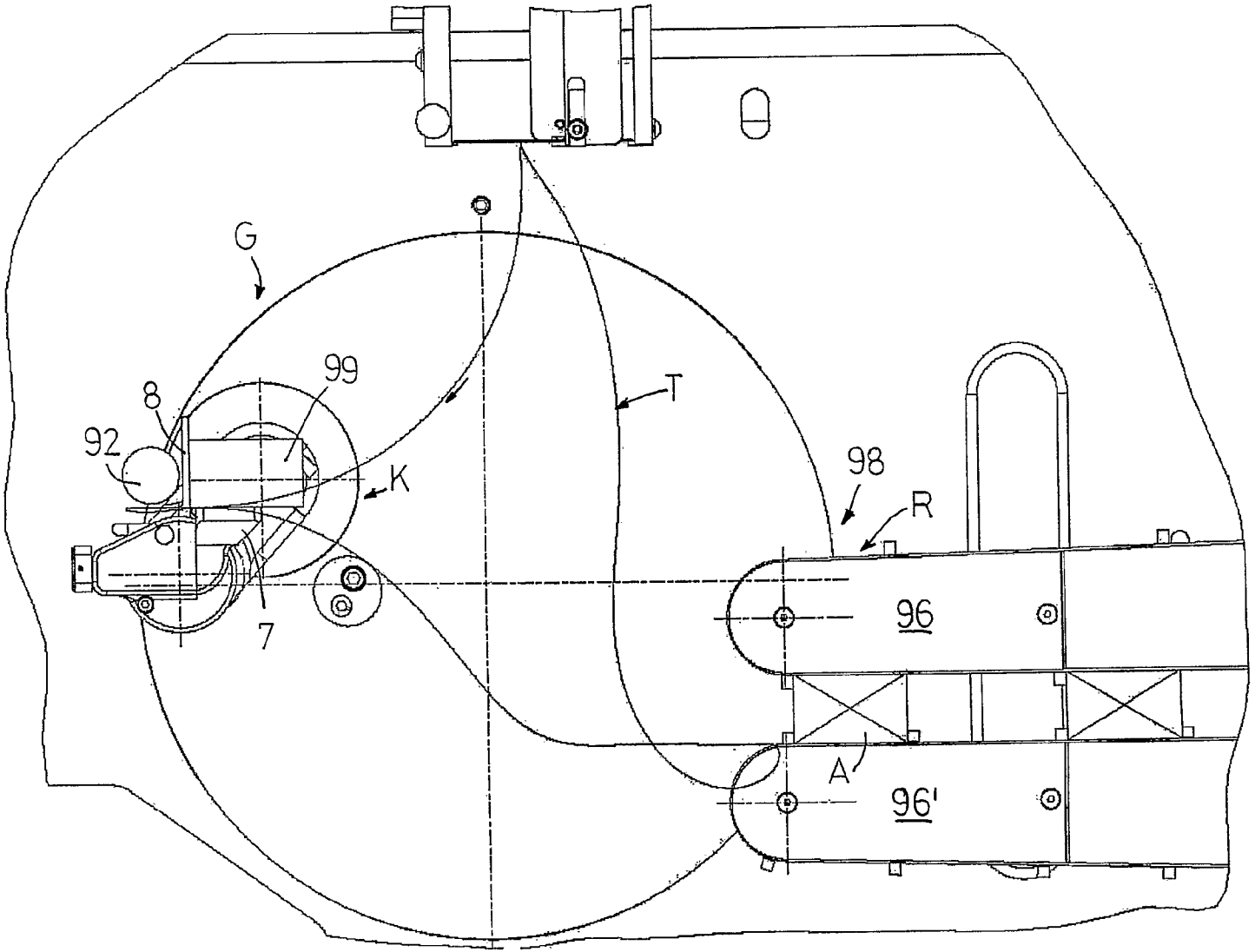
Figure 3D:
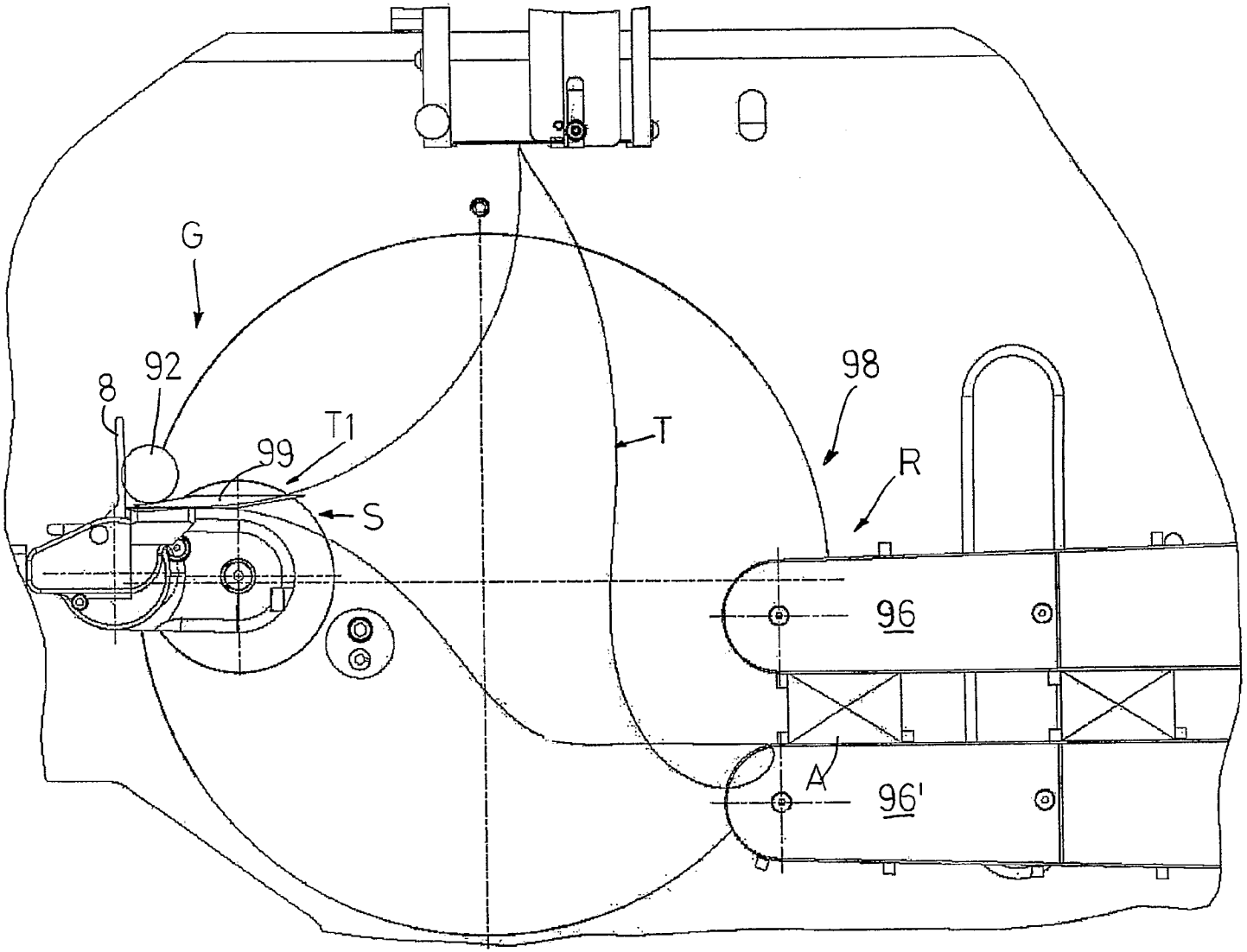
Figure 3E:
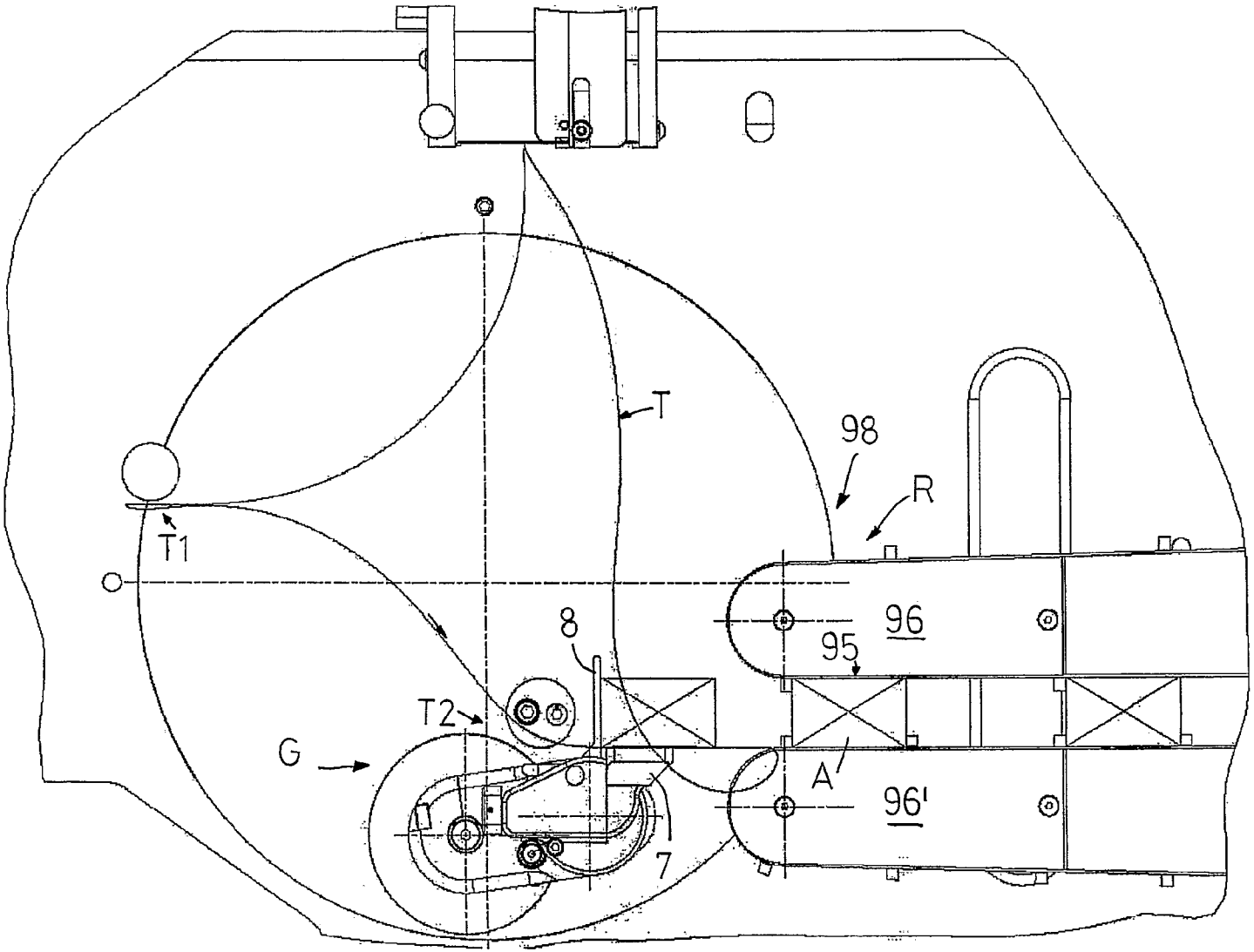
Figure 3F:
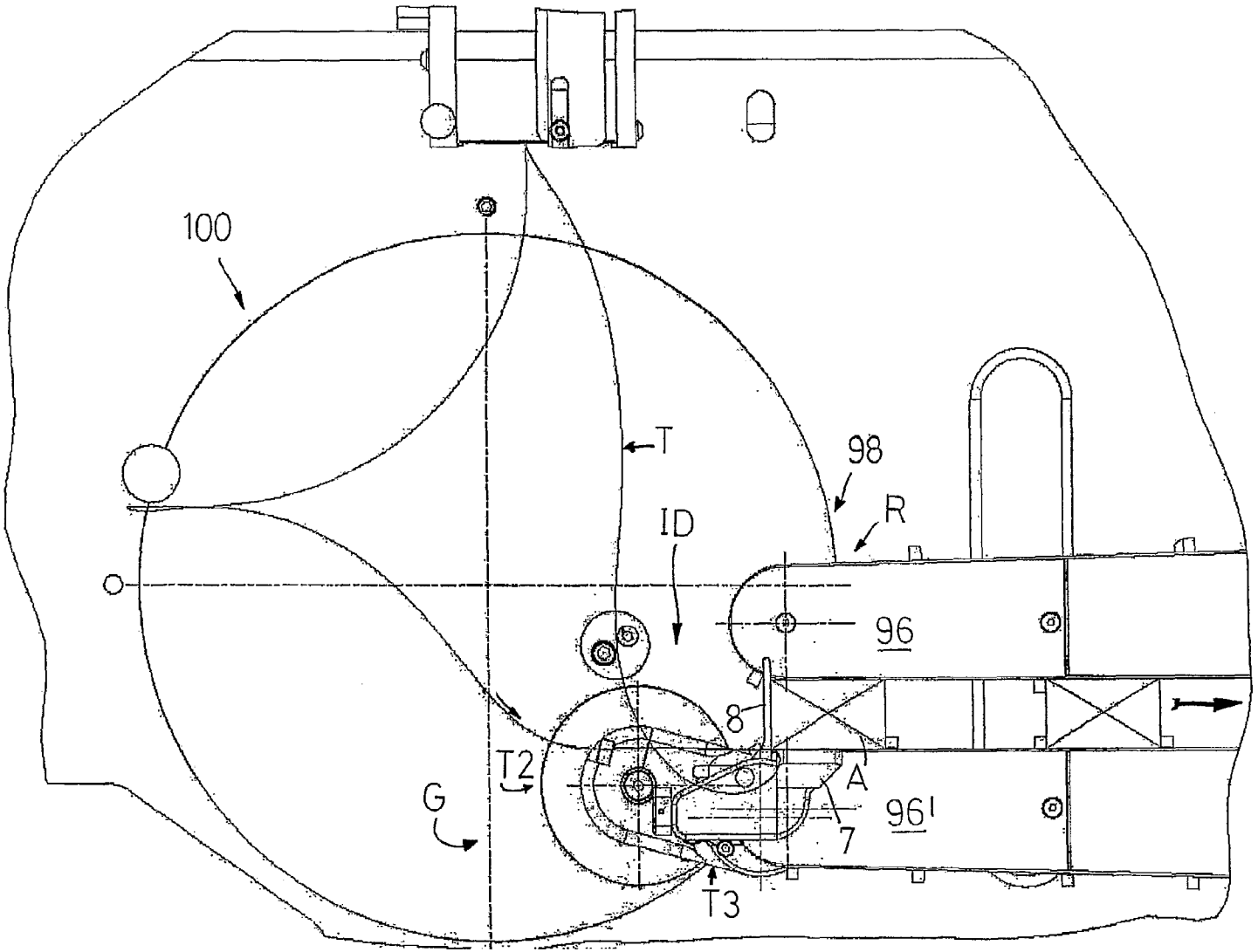
Figure 3G:
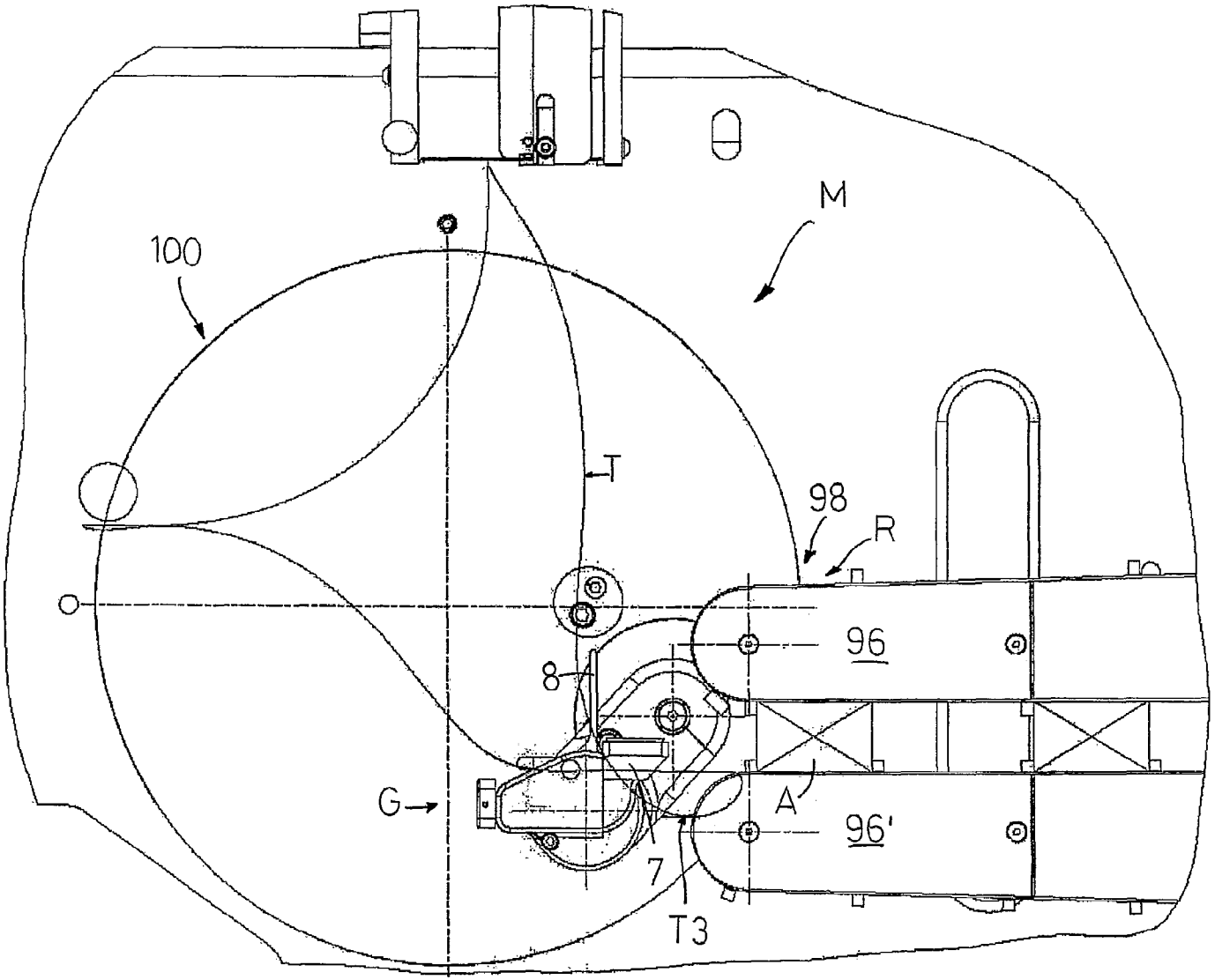
Figure 3H:
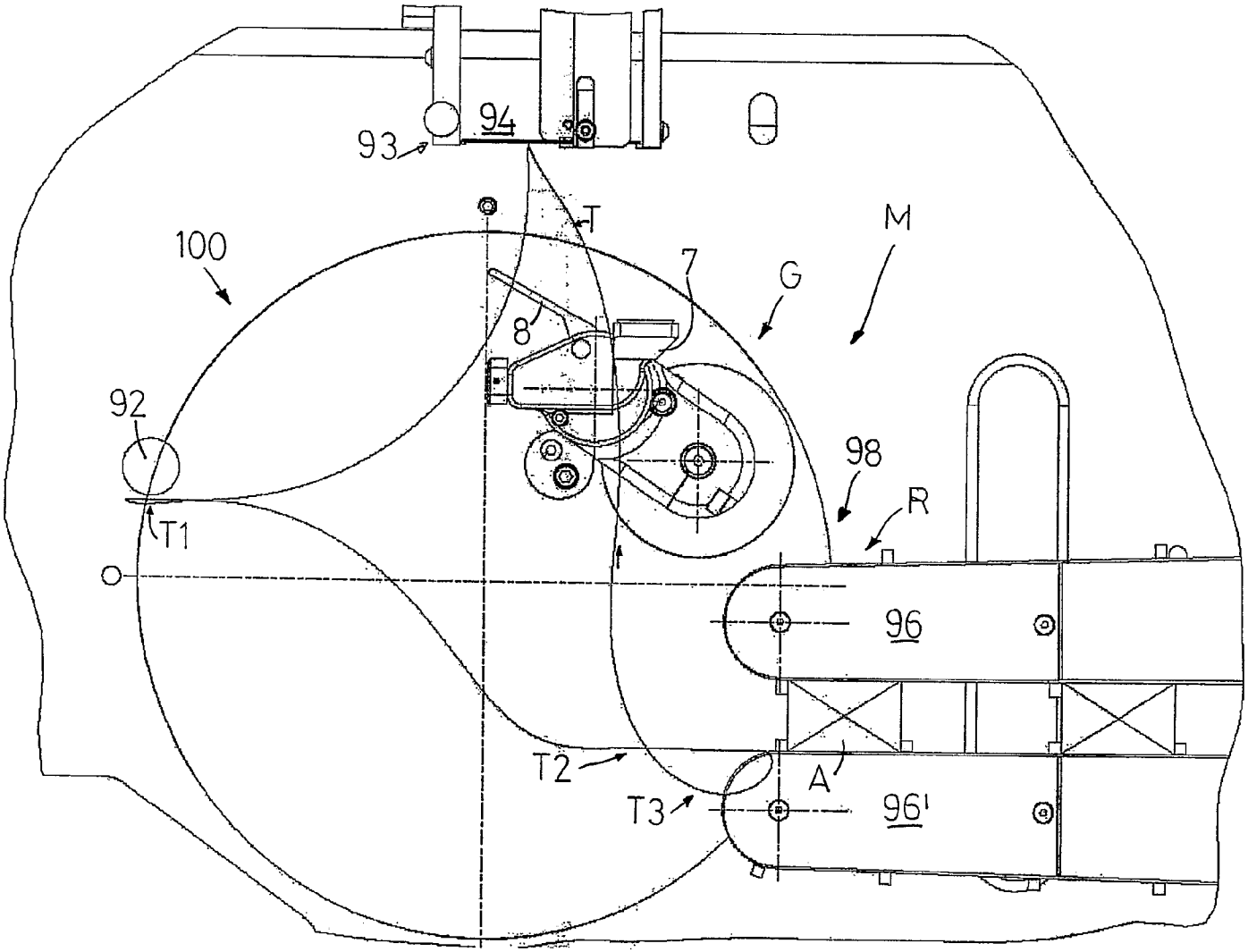

When in use, the picking up group G of the device 100 makes the suction cups V carrier 7 situate itself, with a movement in succession along the closed path T, under the stack 94 (FIG. 3*a*—fixed picking up position P), so as to strip a relevant flat folded blank 99; to begin the erection of the latter into a box-like A configuration by the extensions 8 (FIGS. 3*b* and 3*c*—fixed erecting position K), preferably rhomboid-shaping it, that is pushing the blank 99 against a suitable fixed abutment 92 (FIG. 3*d*—fixed rhomboid-shaping position S), to complete and maintain stable its open box-like A configuration, moving the group G along a portion T1 of the path T (FIGS. 3*a*, 3*d* and 3*h*), substantially having an elongated loop shape, to and from the abutment 92; and then to introduce and place the box A into a relevant compartment 95 of the pair 97 of conveyors 96, 96' (FIGS. 3*e* and 3*f*—fixed introduction and placing position ID), moving along a linear portion T2 of the path T (FIGS. 3*e*, 3*f* and 3*h*), perfectly aligned with the upper run of the conveyor 96', before moving far from the station 98 (FIG. 3*g*) and to begin the upward return motion along the path T, toward the stack 94 and then toward the picking up position P (FIG. 3*h*).

In particular, immediately downstream of the position ID, in which the box A is placed in the compartment 95 of the conveyor 96, 96', the group G performs a downward movement with respect to the conveyors 96, 96', defining a portion T3 of the path T, having substantially a shape of an elongated loop (FIGS. 3*f*, 3*g* and 3*h*), so as to move rapidly away from the conveyors 96, 96', without any possibility of collision.

It is to be pointed out that the proposed device, with respect to the known devices having the same function, offers the possibility of correction of the characteristic path of an epicyclical mechanism (kinematic series C1), of controlling the orientation of the suction cup carrier 7, which moves along the path T (kinematic series C2), and of operating the extensions 8 on the suction cup carrier 7 independently from any other mechanism movement (kinematic series C3).

In particular, the proposed device 100 can integrate the three kinematic series C1, C2 and C3, thus making sufficient the presence of a single axis 5, protruding from the rotor 4, which results in a simple and compact structure.

Generally, the used mechanical scheme allows a considerable independence for defining the paths, which are most suitable to the scheme function and allows the boxes to be processed properly, due to the control of the inclination of the suction cup carrier and of the opening extensions rotation.

Actually, the fundamental characteristic feature of the device derives from the fact that it treats the blanks, aimed at becoming boxes, by picking them up, maintaining them and placing them, always on the same flat bottom surface, without any turning of the blanks, thus avoiding any adjustment of the device, when the height or dimension of the used blanks is changed.

Moreover, the inlet station 98 of the device 100 coincides with the station R of introduction of the products into the boxes A, as already said before, due to the fact that the above described structure allows best and most efficient placing of the blanks, already in their final, open box-like configuration, well defined and complete, which ensures a considerable and advantageous simplification of the machine M, as well as the reduction of the dimensions with respect to the known boxing machines, where the inlet stations can act only as units for transferring boxes to subsequent intermediate, completion stations.

Finally, it is to be pointed out that according to one variant of the present device, not shown, it is possible to mount the magazine 93 at an inclined orientation, determined in such a way, that, by suitably rotating the wheel 3, the suction cup carrier 7 picks up the blanks 99 from the stack 94, which is inclined at a selected angle.

Numerous changes and variants can be applied to the so conceived invention, without leaving the inventive scope thereof.

Further, all the technical detail can be substituted by technically equivalent elements.

The invention claimed is:

1. A device for feeding blanks to a packaging machine, including:

at least one rotating group situated between a magazine with a stack of carton blanks and an inlet station of the packaging machine;

picking up means supported by said group for stripping flat folded carton blanks from a bottom of said stack of blanks, when said group is in a picking up position, and for erecting picked up carton blanks into box-like configurations in an erecting position, and then for feeding the box-like configuration unfolded blanks to an inlet station of said machine, so as to place the unfolded blanks one by one at said inlet station in a placing position;

at least one first kinematic series for controlling movement of said picking up means along a closed path, extending between said picking up position and said placing position; and at least one second kinematic series for controlling and maintaining a constant orientation of said picking up means;

wherein said device further comprises that said group includes a framework carrying cam means, wherein said first kinematic series is defined by said cam means and a lever, which rotates about a rotation axis, said rotation axis defining a planetary element, supported by a satellite carrying rotor, in turn supported by said framework, and with said lever supporting said picking up means, said lever being moved in a way determined by the combination of the rotation of said rotor on an axis, parallel to said rotation axis, and by the rotation of the lever on the rotation axis, controlled by said cam means.

2. A device, as claimed in claim 1, wherein said framework of said group carries a stationary wheel; and said second kinematic series being defined by said stationary wheel and by said picking up means.

3. A device, as claimed in claim 2, wherein said group includes also a pair of extensions, cooperating with said picking up means for erecting said blanks into the box-like configuration in said erecting position;

said pair of extensions being operated by a cam, which in turn is set into rotation by gears, which link said cam to said stationary wheel via a sleeve;

said cam, wheel, extensions, and sleeve defining a third kinematic series of the group, integrated with said first and second kinematic series.

4. A device, as claimed in claim from 3, wherein said orientation of said picking up means is substantially horizontal, with said picking up means moving along said path without rotating.

5. A device, as claimed in claim 1, wherein said picking up position, erecting position and placing position are fixed positions.

6. A device, as claimed in claim 1, wherein said group in said picking up position moves close to said inlet station of said machine along a linear portion of said path.

7. A device, as claimed in claim 1 wherein said group in said placing position moves away from said inlet station of said machine along a portion of said path, having a substantially elongated slot shape.

8. A device, as claimed in claim 1, wherein a rhomboid-shaping position is situated between said erecting position and said placing position, with said group in the rhomboid-shaping position moving along a portion of the path, having a substantially elongated slot shape, to and from a fixed abutment element, against which said erected blank is pushed to stabilize its box-like configuration.

9. A device, as claimed in claim 1, wherein said inlet station coincides with a station for introducing various products into said blanks erected to their box-like configuration.

10. A device, as claimed in claim 1, wherein said inlet station includes conveyor means with compartments for receiving said blanks erected to their box-like configuration.

* * * * *